US006029899A

United States Patent [19]

Walker

[11] Patent Number: 6,029,899

[45] Date of Patent: Feb. 29, 2000

[54] TABLE TOP FOUNTAIN

[75] Inventor: John M. Walker, Grapevine, Tex.

[73] Assignee: Beckett Corporation, Irving, Tex.

[21] Appl. No.: 09/223,980

[22] Filed: Jan. 4, 1999

[51] Int. Cl.[7] ..... B05B 17/08

[52] U.S. Cl. ..... 239/17; 239/21; 239/22; 239/23

[58] Field of Search ..... 239/17, 16, 21, 239/22, 23, 211

[56] References Cited

U.S. PATENT DOCUMENTS

| | | | |
|---|---|---|---|
| 219,946 | 9/1879 | Huber | 239/23 |
| 782,612 | 2/1905 | Levy | 239/23 |
| 1,049,050 | 12/1912 | Chone | 239/23 |
| 1,888,784 | 11/1932 | Bauer | 239/23 |
| 1,954,704 | 4/1934 | Kraus | 239/23 |
| 2,974,871 | 3/1961 | Naythons | 239/23 |
| 3,286,927 | 11/1966 | Zysk | 239/23 |
| 3,409,223 | 11/1968 | Gosh | 239/23 |
| 3,691,787 | 9/1972 | Kaufman | 239/23 |
| 3,713,583 | 1/1973 | Gruber | 239/23 |
| 4,836,142 | 6/1989 | Duback | 239/23 |

*Primary Examiner*—Kevin Shaver
*Assistant Examiner*—David Deal
*Attorney, Agent, or Firm*—Sidley & Austin

[57] ABSTRACT

A table top fountain (10, 60, 70, 80) is disclosed which provides for discharge of water in a fountain-like effect to spray on a series of rocks mounted within a container (12). An electric pump (34) is mounted in the interior of the container (12). A power cord (38) extends from the pump through a passage (32) in an upwardly extending column (28) extending upward from the bottom (14) of the container. A seal plug (40) sealingly engages the power cord (38) and is sealed to the column (28) to prevent water from leaking through the passage. With the power cord exiting the bottom of the fountain, a neater appearance is provided for the fountain.

15 Claims, 2 Drawing Sheets

TABLE TOP FOUNTAIN

TECHNICAL FIELD OF THE INVENTION

This invention relates to a table top fountain and, in particular, a seal therefor.

BACKGROUND OF THE INVENTION

The sound, appearance and other attractions of a water fountain are enjoyed by many people. Designs have been created for fountains that can actually be used in an interior of a house or office, for example. One design of this type is used on the top of a table or other flat surface and causes water to fall on top of stones or other natural elements to provide a pleasant sound and visual attraction. However, the designs mounted on a table top risk leakage of water onto the table top, potentially ruining the finish. The need exists to minimize this risk.

SUMMARY OF THE INVENTION

In accordance with one aspect of the present invention, a fountain is provided which includes a container having an interior for holding a fluid. The fluid is permitted to fill the interior of the container to a predetermined liquid level. The container has a portion forming a fluid containing surface in the interior. The portion has a column extending from the surface into the interior. A passage is formed through the column which connects the interior to exterior the fountain. The passage ends in the interior at an inner end of the column. At least a portion of the inner end is exposed to the liquid. A member extends through the passage from exterior the container to the interior. A seal plug seals between the column and the member to prevent liquid leakage through the passage.

A pump can be mounted in the interior of the container and powered through the member. In accordance with another aspect of the present invention, the seal plug sealingly engages the member with a compression seal. In accordance with another aspect of the present invention, the member is an electric cord. The seal can have an annular collar to fit over the inner end of the column. Rocks can be mounted in the interior and the pump can be provided with a spray attachment to spray the liquid over the rocks.

BRIEF DESCRIPTION OF THE DRAWINGS

For a more complete understanding of the present invention and for further advantages thereof, reference is now made to the following detailed description, taken in conjunction with the following figures.

DETAILED DESCRIPTION OF THE INVENTION

Figure 1:
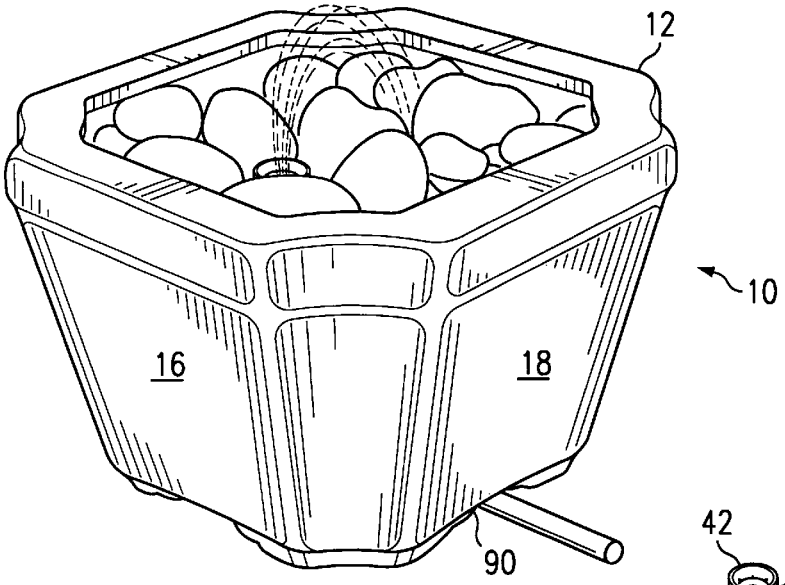
FIG. 1 is a perspective view of a table top fountain forming a first embodiment of the present invention.
Figure 2:
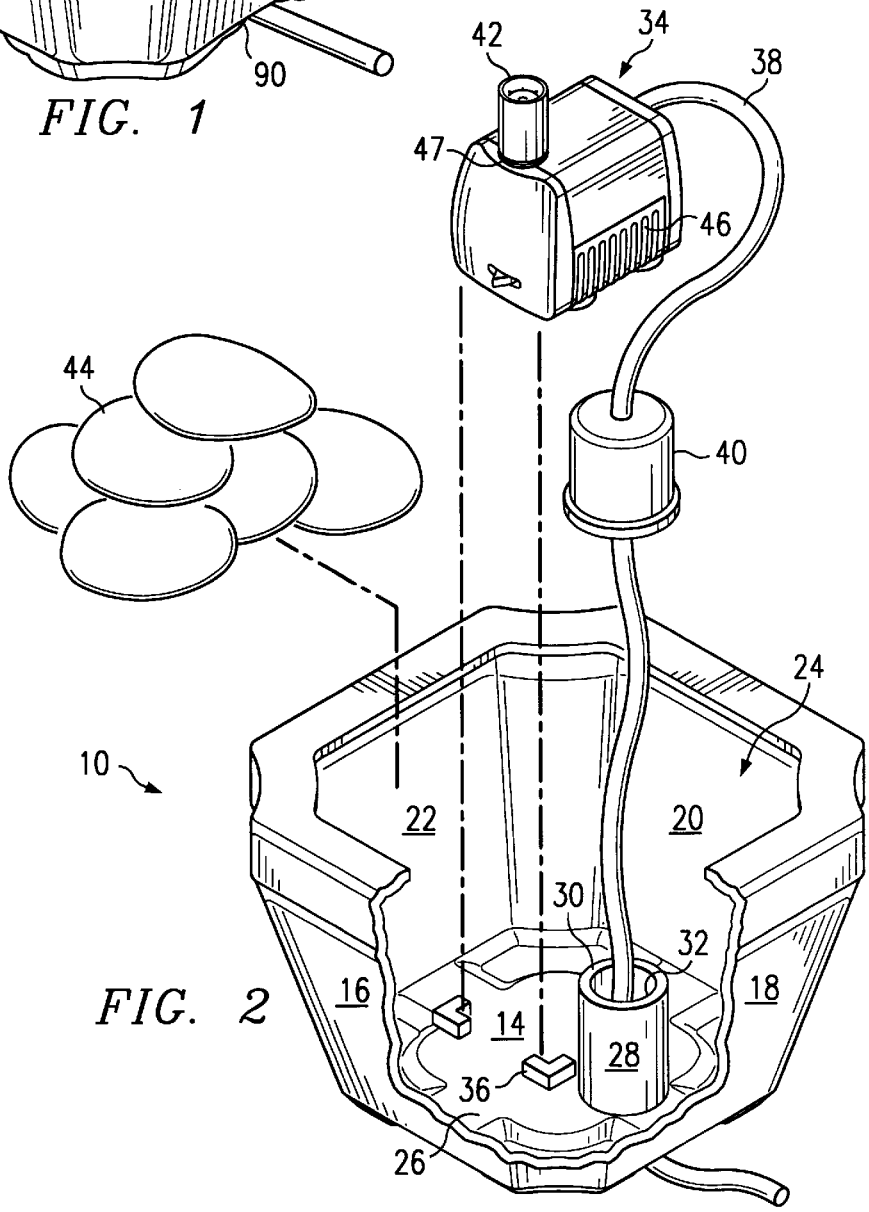
FIG. 2 is an exploded view, partially cut away, of the table top fountain of FIG. 1.
Figure 3:
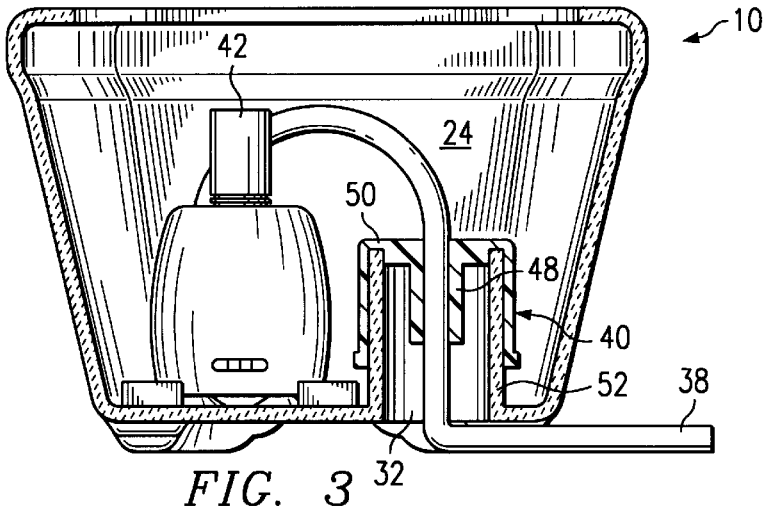
FIG. 3 is a vertical cross-sectional view of the table top fountain of FIG. 1.

With reference now to FIGS. 1–3, a first embodiment of the present invention will be described which is formed by table top fountain 10. The fountain 10 includes a container 12 which can be formed of any suitable material, such as metal, ceramic, concrete, plastic and so forth. The container defines a bottom 14 and four walls 16, 18, 20 and 22. The bottom and walls combine to define an interior 24 for holding a liquid, typically water, although oils or other suitable liquids can be used.

The bottom 14 defines an inner surface 26. Extending upwardly from the inner surface 26 and formed integrally with bottom 14 is a cylindrical column 28 having a passage 32 therethrough. The column ends within the interior at an annular end surface 30. The passage 32 of the column extends through the bottom 14 and is open to the exterior of the fountain 10. At least a portion of the end surface 30 will typically be below the normal level of water inside the interior 24, or at least be exposed to the water sprayed in the fountain, giving rise to the risk of water leaking from the fountain through passage 32.

A waterproof fountain pump 34 is mounted within the interior 24 and can be oriented on the bottom by molded positioning structure 36 extending upwardly from the inner surface 26. The pump 34 is preferably an electrically operated pump of the type disclosed in copending U.S. patent application Ser. No. 09/023,608, filed Feb. 13, 1998, which is hereby incorporated herein by reference in its entirety. The pump has an intake 46 and a discharge 47. The electrical cord 38 to power the pump can be seen to extend from the pump, through the passage 32 and exterior the fountain 10. The cord 38 preferably ends in a common plug (not shown) for use in a wall socket, although the cord can be connected to power by direct wiring if desired.

A seal plug 40 sealingly engages the power cord 38, as shown in FIG. 2, and is designed to fit over the column 28 to provide a fluid tight seal between the cord 38, plug 40 and the column 28 to prevent water from leaking from the fountain 10 through passage 32.

The discharge 47 of pump 34 is preferably through a spray adapter 42 which causes the water pumped by the pump to spray upwardly in a fountain-like effect. Preferably, stones 44 are placed in the interior 24 so that the water splashes down on the stones, providing an attractive sound and visual experience.

Of course, the water sprayed from the pump will impact on the rocks and drain down further within the interior 24 to be recycled at the pump inlet 46.

Reference to FIG. 3 illustrates further details of the seal plug 40. The plug can be seen to have a cylindrical plug portion 48 with a passage therethrough to fit over the power cord 38 and form a fluid tight compression seal therewith and an annular collar 50 which extends over the annular end surface 30 of the column 28 and sealingly engages the exterior surface 52 of the column 28. The passage through the plug portion 48 that receives the power cord 38 is formed smaller in diameter than the diameter of the power cord 38. The plug 40 is resiliently deformed to expand the diameter of the passage to fit the power cord 38 through the passage and then released so that the passage squeezes the cord, forming the fluid tight compression seal. While it is preferred plug 40 form a simple compression seal with cord 38, it is also possible to mold the plug to the outer surface of the cord.

Preferably, the seal plug 40 is molded of silicon rubber. The seal plug 40 provides a fluid tight seal to the column 28 as well as the power cord 38. However, if additional sealing protection is desired, a suitable sealant compound can be applied between the plug 40 and column 28 and between the plug 40 and cord 38.

One advantage of the present invention is the fact that the seal plug 40 can be removed from column 28 as needed to repair or replace the pump 34. For this reason, it is desired that the passage 32 be large enough to allow passage of the plug at the end of the cord 38 to facilitate pump repair or replacement.

As can be appreciated, with the cord 38 exiting through the bottom 14 of the container 12, the cord 38 is effectively hidden from view by the container 12. The cord 38 may not even be visible to the observer if the container is positioned on the table top or other surface so that the portion of the cord extending to the electric outlet is hidden as well.

While pump 34 is preferably electric, a pump powered by another power source, such as pressurized air, can be used instead. If an air operated pump is used, cord 38 can be replaced by an air pressure line extending through passage 32 to an exterior air source. Seal plug 40 would then sealingly engage the air line.

Figure 4:
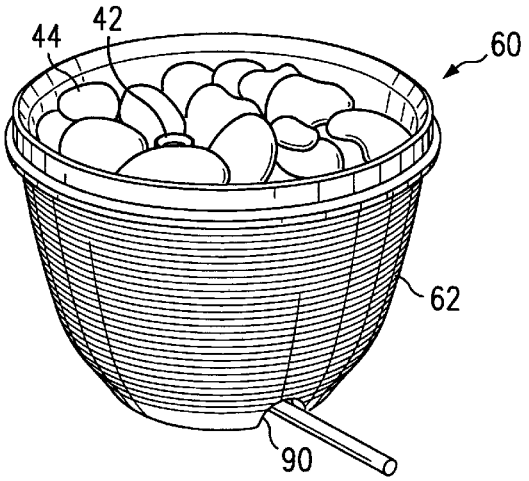
FIG. 4 is a perspective view of a first modification of the table top fountain.

Reference to FIG. 4 illustrates a table top fountain 60 forming a first modification of the present invention. The fountain 60 has a tapered cylindrical wall 62 as opposed to four side walls as shown in fountain 10. In all other respects, the fountain 60 is substantially identical to fountain 10.

Figure 5:
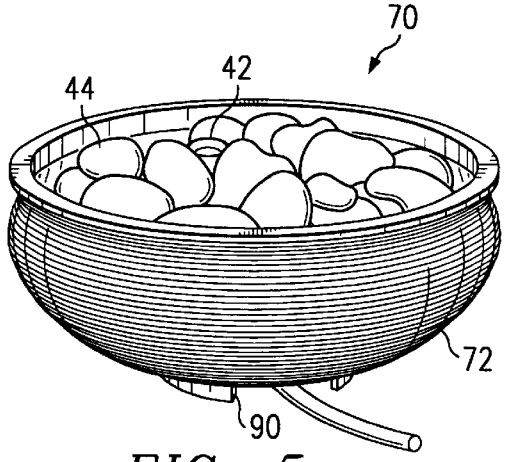
FIG. 5 is a perspective view of a second modification of the table top fountain.

Reference to FIG. 5 illustrates a second modified container 70 which has a bowl-shaped wall 72. Again, the fountain 70 is otherwise substantially identical to the fountain 10.

Figure 6:
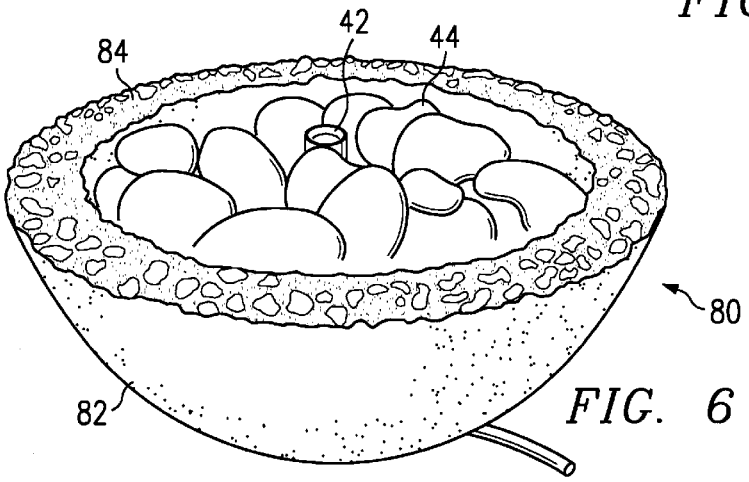
FIG. 6 is a perspective view of a third modification of the table top fountain.

FIG. 6 illustrates a third modified table top fountain 80 which is formed of concrete. The fountain has a wall 82 which extends from the bottom of the fountain 80 upwards to an upper annular surface 84. Again, in all other respects, the fountain 80 is substantially identical to fountain 10.

It should be noted that containers 10, 60 and 70 each have a cutout 90 in their bases to allow the cord 38 to pass through the cutout 90 and allow the container to rest firmly on the table top on its base.

While the containers have been illustrated and described with the column extending from the bottom thereof, the column can extend from a side wall thereof instead. In such a design, the portion of the side wall through which the cord extends would normally be the portion out of the view of the observer.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A fountain, comprising:

a container having an interior for holding a fluid, the fluid permitted to fill the interior to a predetermined liquid level, the container having a bottom, said bottom defining an inner surface within the interior, the bottom having a column extending from the inner surface upwardly into the interior and defining a passage therethrough communicating between the interior and exterior the container, said column ending at an inner end, at least a portion of the inner end being exposed to the liquid;

an electric pump mounted within the interior of the container and supported on the bottom, the pump having an electric cord extending therefrom, the electric cord extending through the passage in the column; and a seal plug sealingly engaging the electric cord and sealing to the column to prevent liquid leakage through the passage of the column.

2. The fountain of claim 1 wherein the pump has a discharge formed by a discharge diffuser.

3. The fountain of claim 1 further having stones mounted in the interior thereof.

4. The fountain of claim 1 wherein the seal plug has an annular collar fitting over the inner end of the column.

5. A fountain, comprising:

a container having an interior for holding a fluid, the fluid permitted to fill the interior to a predetermined liquid level, the container having a portion forming a fluid containing surface in the interior, the portion having a column extending from the surface into the interior and ending at an inner end, at least a portion of the inner end exposed to said liquid, the column having a passage extending from the inner end of the column through the column to exterior the fountain;

a member extending through the passage from exterior the container to the interior of the container; and a seal plug sealing between the column and the member to prevent liquid leakage through the passage.

6. The fountain of claim 5 wherein the member is an electric cord.

7. The fountain of claim 5 wherein the seal plug forms a fluid tight compression seal with the member.

8. The fountain of claim 5 wherein a pump is mounted in the interior of the container, the pump being powered through the member.

9. The fountain of claim 8 wherein the pump is an electric pump.

10. The fountain of claim 8 wherein the pump sprays liquid.

11. The fountain of claim 10 wherein the pump has a discharge diffuser.

12. The fountain of claim 8 wherein the surface has members formed thereon to align the pump within the interior of the container.

13. The fountain of claim 5 wherein the seal plug has an annular collar to fit over the inner end of the column.

14. The fountain of claim 5 wherein the portion is a bottom of the container, the column extending upward from the bottom thereof.

15. The fountain of claim 5 further comprising a plurality of stones filling a portion of the interior of the container.

* * * * *